US011219308B2

(12) United States Patent
Globerman

(10) Patent No.: US 11,219,308 B2
(45) Date of Patent: Jan. 11, 2022

(54) METHOD FOR MAKING SHELVES

(71) Applicant: Eyal Globerman, Petach Tiqwa (IL)

(72) Inventor: Eyal Globerman, Petach Tiqwa (IL)

( * ) Notice: Subject to any disclaimer, the term of this patent is extended or adjusted under 35 U.S.C. 154(b) by 1 day.

(21) Appl. No.: 16/586,986

(22) Filed: Sep. 29, 2019

(65) Prior Publication Data

US 2020/0054126 A1 Feb. 20, 2020

Related U.S. Application Data

(63) Continuation of application No. PCT/IL2018/050379, filed on Mar. 29, 2018.

(60) Provisional application No. 62/480,570, filed on Apr. 3, 2017, provisional application No. 62/533,685, filed on Jul. 18, 2017.

(51) Int. Cl.
*A47B 57/40* (2006.01)
*A47B 47/00* (2006.01)

(52) U.S. Cl.
CPC ..... *A47B 57/406* (2013.01); *A47B 47/0083* (2013.01)

(58) Field of Classification Search
CPC ... A47B 57/406; A47B 57/404; A47B 57/402; A47B 57/40; A47B 57/408; A47B 57/06; A47B 57/16; A47B 57/18; A47B 57/20; A47B 57/22; A47B 57/26; A47B 57/30; A47B 47/0083; A47B 47/02; A47B 47/021; A47B 47/028
See application file for complete search history.

(56) References Cited

U.S. PATENT DOCUMENTS 1,401,041 A * 12/1921 Chipperfield ..... A47B 47/021 312/257.1
3,045,834 A * 7/1962 Seiz ..... A47B 57/50 211/191
3,127,995 A 4/1964 Mosinski
3,195,735 A * 7/1965 Jay ..... A47B 57/408 211/191
3,565,264 A 2/1971 Guiher
4,064,996 A 12/1977 Shillum
4,406,374 A * 9/1983 Yedor ..... A47B 57/40 211/192

(Continued)

FOREIGN PATENT DOCUMENTS

DE 1854375 A1 * 11/2007 ..... A47B 57/40
EP 0217144 4/1987

(Continued)

*Primary Examiner* — Patrick D Hawn

(57) ABSTRACT

A rack for shelving consisting of upright posts and horizontal beams, connecting each between two upright posts, wherein said upright posts comprise. The upright posts include each at least one flank demonstrating one column of through gamma perforation doublets. The horizontal beams are either depth forming beams or width forming beams. The width forming beams include each at each of each extremity two rows of one doublet of fasteners adapted to fit with the gamma perforations so that the entire number of individual fasteners in those two rows of said perforations find each a matching perforation. The fasteners of the width forming beam are formed including each a cross recess of the width matching the width of the flank of the upright posts.

18 Claims, 11 Drawing Sheets

(56) References Cited

U.S. PATENT DOCUMENTS

| | | | | | |
|---|---|---|---|---|---|
| 4,549,665 | A * | 10/1985 | Smitley | A47B 57/22 | 211/191 |
| 4,711,183 | A * | 12/1987 | Handler | A47B 57/402 | 108/107 |
| 5,295,446 | A | 3/1994 | Schafer | | |
| 5,452,812 | A | 9/1995 | Niequist et al. | | |
| 5,735,221 | A * | 4/1998 | Benayon | A47B 47/024 | 108/107 |
| 5,975,318 | A * | 11/1999 | Jay | A47F 5/101 | 211/150 |
| 6,216,415 | B1 | 4/2001 | Briosi | | |
| 6,273,281 | B1 * | 8/2001 | Berglund | A47B 57/50 | 108/107 |
| 6,920,831 | B2 * | 7/2005 | Lin | A47B 57/40 | 108/107 |
| 7,337,729 | B2 | 3/2008 | Briosi | | |
| D683,983 | S | 6/2013 | Troyner et al. | | |
| 9,351,567 | B2 * | 5/2016 | Go | A47B 57/16 | |
| 9,474,370 | B2 * | 10/2016 | Troyner | A47F 5/0807 | |
| D777,480 | S * | 1/2017 | Anderson | D6/675.2 | |
| 10,299,589 | B1 * | 5/2019 | Lai | A47B 96/145 | |
| 2001/0013209 | A1 * | 8/2001 | Waalkes | E04B 2/7433 | 52/239 |
| 2007/0062898 | A1 * | 3/2007 | Choi | A47B 57/408 | 211/192 |

FOREIGN PATENT DOCUMENTS

| | | |
|---|---|---|
| EP | 0486895 | 5/1992 |
| EP | 0890330 | 1/1999 |
| FR | 2889654 | 2/2007 |

* cited by examiner

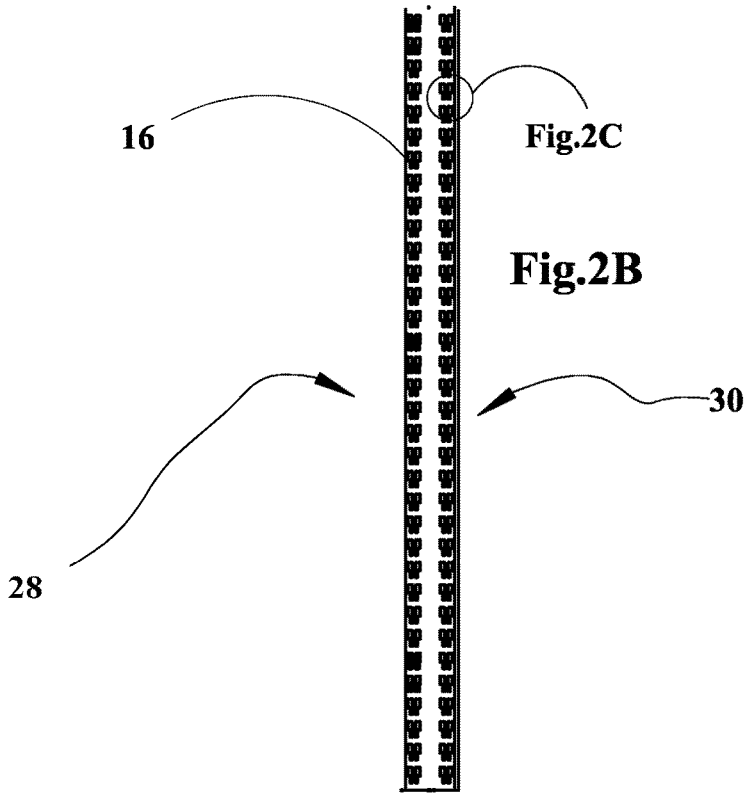
16
Fig.2C
Fig.2B
30
28
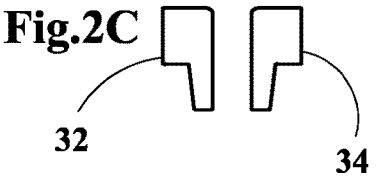
Fig.2C
32
34

Fig. 3A
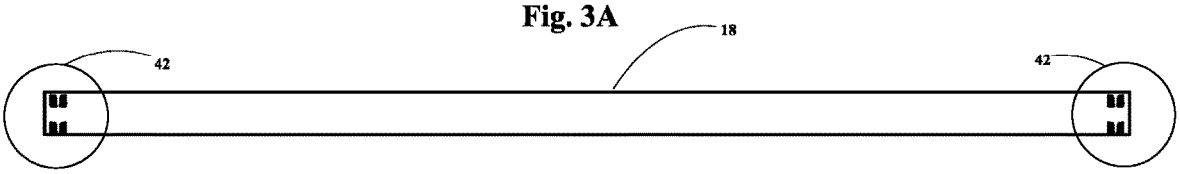
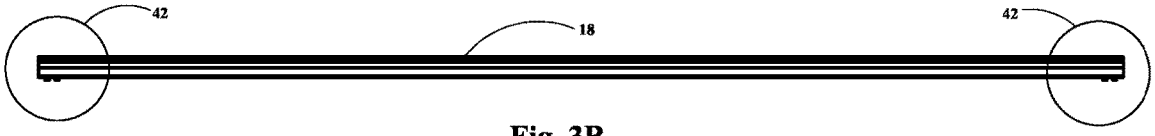
Fig. 3B

METHOD FOR MAKING SHELVES

CROSS-REFERENCE TO RELATED APPLICATIONS

This application is a continuation of PCT/IL2018/050379 filed 29 Mar. 2018, which claims benefit of U.S. Provisional Patent Application No. 62/480,570 filed 3 Apr. 2017 and of U.S. Provisional Patent Application No. 62/533,685 filed 18 Jul. 2017.

The contents of the above applications are all incorporated by reference as if fully set forth herein in their entirety.

TECHNICAL FIELD

The present invention relates to metal shelving. The construction of pallet racks from components and specifically to joining upright posts with the horizontal beams to form a scaffolding unto which shelves are laid.

BACKGROUND ART

The use of pallet racks is common in warehouses and stores. Such appliances are designed to receive product bearing pallets typically from a forklift truck.

Typically such racks are constructed from upright posts into which horizontal beams are connected. See for example European patent application EP 3042865A1.

BRIEF DESCRIPTION OF THE DRAWINGS

FIG. 2B illustrates a upright post in accordance with the present invention featuring a double column of doublets of perforations.

FIG. 2C illustrates in detail the two perforations in each doublet.

FIG. 3A illustrates features of a broad side of a horizontal width forming beam.

FIG. 3B illustrates fasteners of a narrow side of a width forming beam.

FIG. 3C is an isometric view of a horizontal beam showing placement of the fasteners.

FIG. 3D is an enlarged isometric extremity of a horizontal width forming beam.

DESCRIPTION OF EMBODIMENTS

The present invention is implemented in the technical environment of storage racks, such as pallet racks and shelves. This invention relates to structural elements and joining them together in a specific form whereby joining and supporting members of structures such as shelf racks, scaffolding, and the like. It is a particularly important object of the invention to provide new and improved joints for connecting a supporting member and a supported member.

The present invention provides a system along with a method for constructing racks, emphasizing sturdy joining aspects and strong posts and horizontal beams, whereby weight of the components is kept low.

Figure 1:
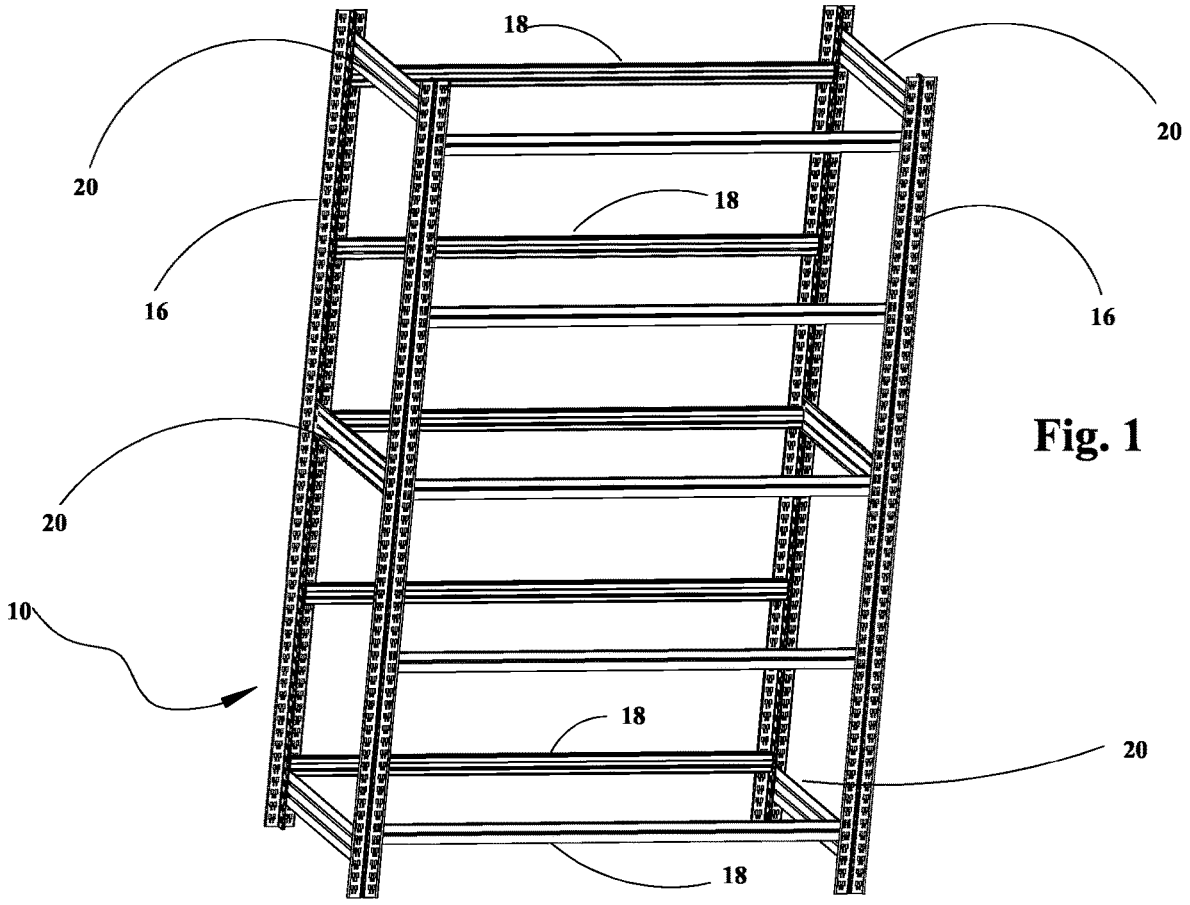
FIG. 1 is an isometric view of a four posted rack in accordance with the present invention.

A general view of a simple rack 10 demonstrating some aspects of the invention is presented in FIG. 1. Rack 10 includes four upright posts 16 also referred to simply as "uprights" connected horizontally by two types of beams. Width forming beams 18 forming the width of the rack, and depth forming beams 20 that form the depth of rack 10.

A prominent aspect of the invention is the width joining system, to explain how this works, first the structural elements involved are described.

The Upright Posts

The posts shown in the figure are typically configure to form corners, however, there are upright posts configured otherwise.

Figure 2A:
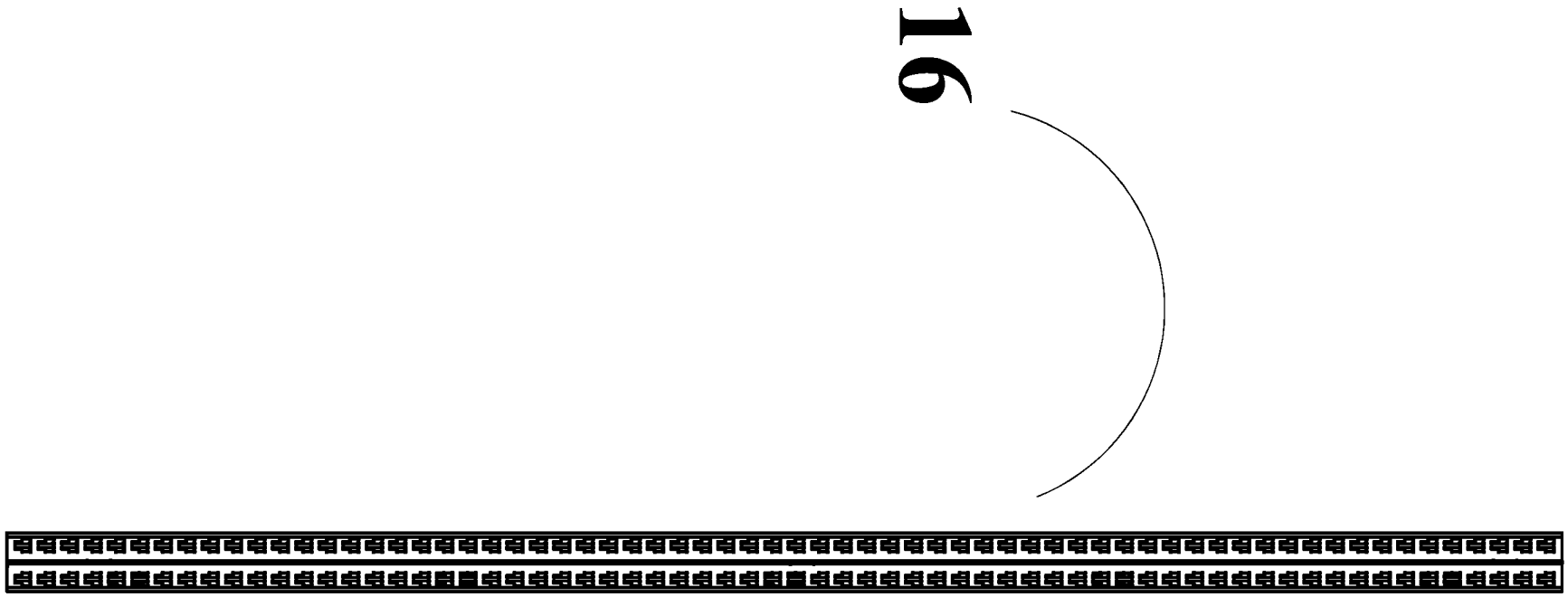
FIG. 2A illustrates a vertical (upright) post in accordance with the present invention, having a T profile.

As can be seen in FIG. 2A, upright post 16 features, having a T profile, such that two matching rows of vertically arranged columns of perforations as shown enlarged, with reference to FIG. 2B. Upright post 16 has the two flanks, left flank 28 and right flank 30. Each of the flanks features a column of doublets of through-perforations which will be related to as (gamma) perforations infra. As can be seen in FIG. 2C the two perforations in each doublet are axisymmetrical with respect to each other such that perforation 32 (left) is identical but chirally opposed to perforation 34. Both perforations are cutouts in the profile of the flanks 28 and 30 respectively. The perforations do not have any voluminous features.

The fasteners that fit in within these perforations do possess voluminous features and are therefore three dimensionally structured. The fasteners which fit in within the perforations are a part of the width forming beams. Before explaining how the joining works, important structural features of the horizontal beams are described.

The Horizontal Width Forming Beams

Figure 3E:
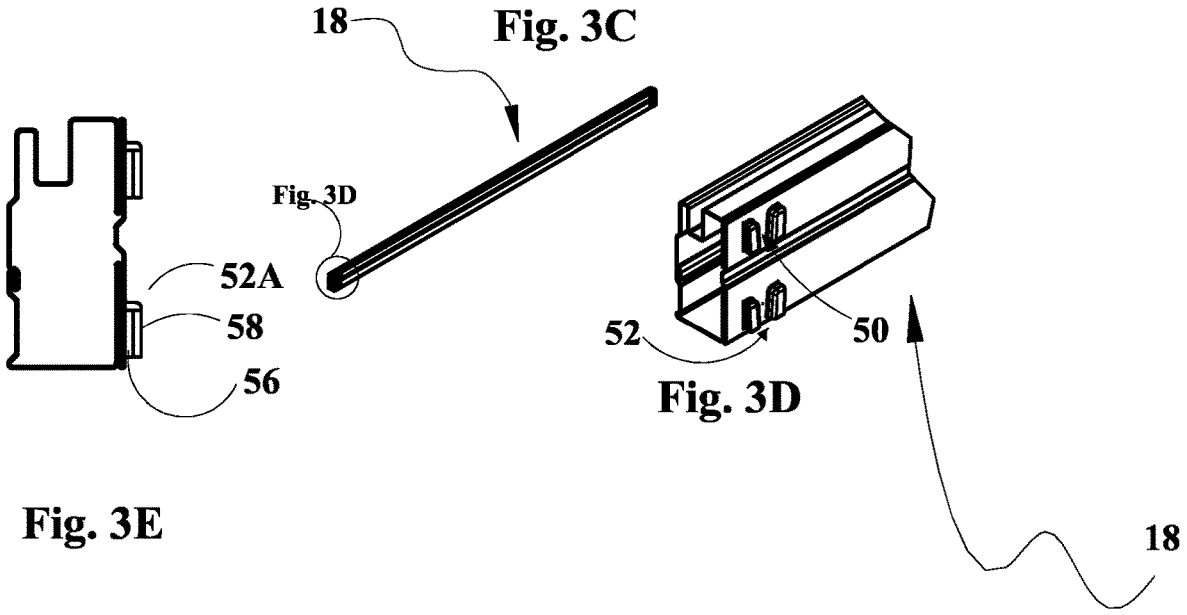
FIG. 3E is an enlarged extremity of a horizontal width forming beam showing fasteners with relation to profile.
Figure 3G:
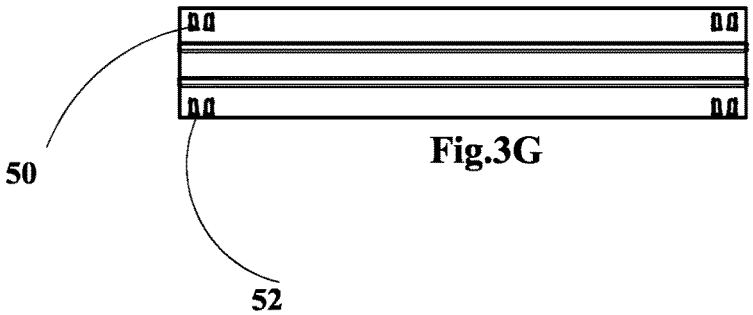
FIG. 3G is a broadside view of fasteners of a beam.
Figure 3H:
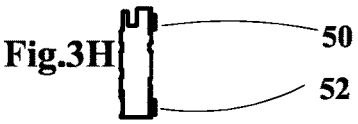
FIG. 3H is view of fasteners of a beam.
Figure 3F:
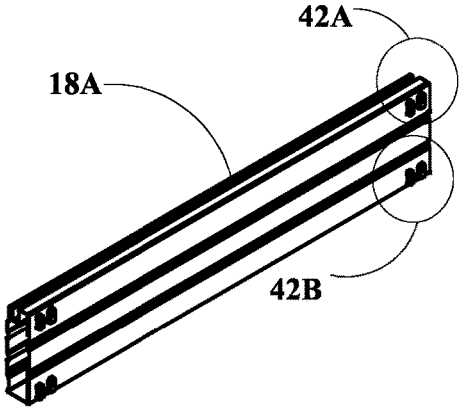
FIG. 3F is a perspective view of fasteners groups of a beam.

In FIG. 3A the broad side of horizontal beam 18 is shown, featuring on both extremes fastener group 42. Looking from the narrow side of beam is, at FIG. 3B the two groups of fasteners 42 can be seen extending from the otherwise flat surface of the beam. In FIG. 3C the beam 18 is shown with the fasteners. All the fasteners extend from the same surface as can be seen in FIG. 3D an enlarged view of one group of fasteners at the extremity of horizontal beam. Thus there are two horizontally arranged doublets of fasteners including on the upper side fasteners 50 and on the lower side fasteners 52. The two doubles are identical and can be simultaneously fit inside two doublets of perforations as described above with reference to FIG. 2B. The positioning of the fasteners with respect to the horizontal beam and the profile from which it is made are described more clearly in the enlarged view demonstrated in FIG. 3D. In FIG. 3E some features of the fasteners are shown and discussed following.

Fasteners, Structural Aspects Thereof, Interaction with the Upright Post and the Gamma Perforations in Particular As demonstrated in FIG. 3E Fastener 52A has recess 56 at one side, and a frontal cover 58. The interaction of the fastener 52 (for the sake of clarity the post is not shown) with upright post 26 is explained with reference to FIGS. 4A-5B.

Figure 4A:
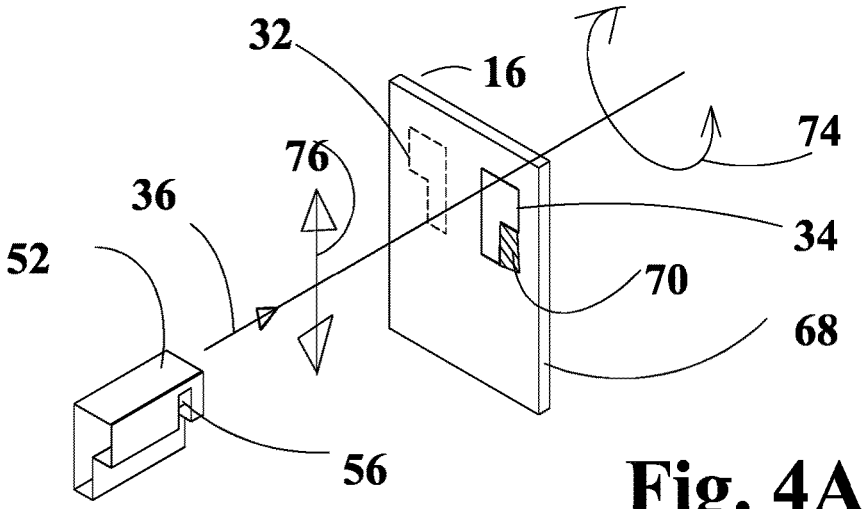
FIG. 4A is an enlarged isometric view of the fastener interaction with the gamma perforation.
Figure 4B:
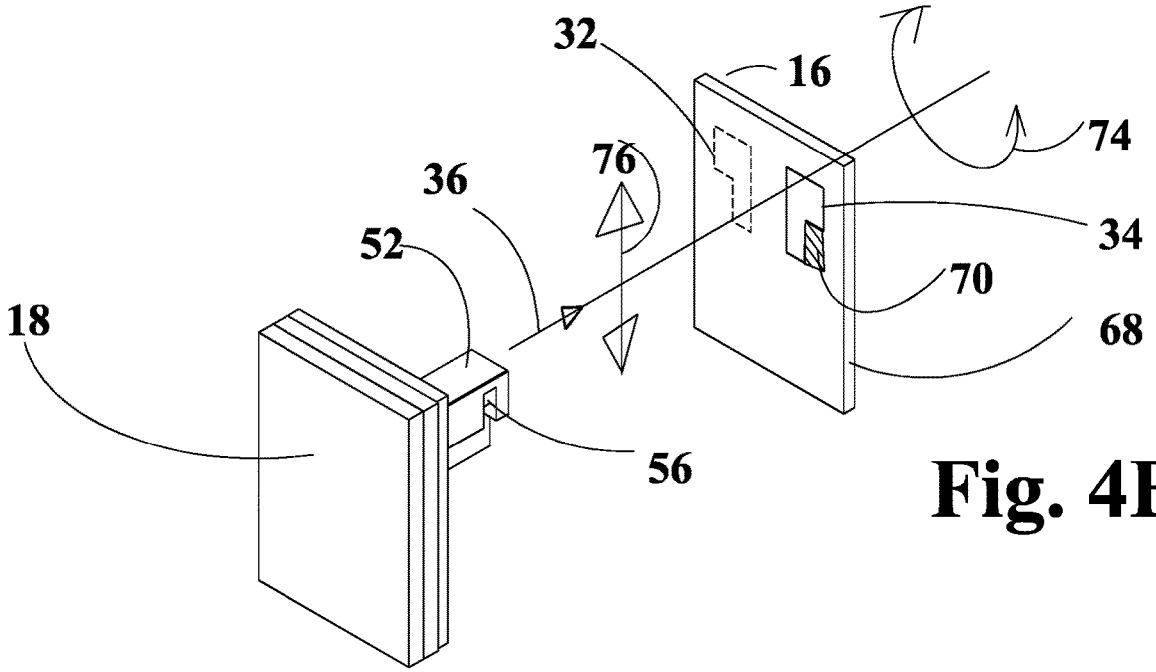
FIG. 4B is an enlarged isometric view of the fastener interaction with the gamma perforation showing more detail.

In FIGS. 4A and B, upright post 26 features two chirally arranged perforations. 32 and 34, the rest of the discussion below deals with perforation 34 in more detail. Fastener 52 points at a matching perforation 34 (arrow 36) and when poked at the perforation, cross recess 56 gets aligned with the width dimension 68 of upright post 26 this alignment allows fastener 52 to be pushed down while being inserted in the perforation 34, so that metal projection 70 (shown hatched) is entangled within recess 56. Thus in order to implement the construction fastening of the invention, several movements are to be executed sequentially, as follows. First fastener 52 is poked into a matching gamma perforation 34, (in the direction of arrow 36) then the fastener is lowered (pushed down) in the direction of double headed arrow 76 (lower part) optionally forcefully, this is also the direction of gravity pull. As a result, fastener 52 and post 72 to which it is attached (shown in FIG. 4B only) become engaged with upright post 26. The tenacity and stability of the link between the width forming post not shown, but the manner by which the fastener is attached prevents swiveling of the fastener 52 in the direction as described by double headed arrow 74 (around axis—arrow 36) because it is a rectangular box restrained by the sides (broad and narrow) of gamma perforation 34. Up and down movement as indicated by double headed arrow 76 is restrained by the top and bottom walls of the gamma perforation. The engagement of fastener 52 with metal flap 70 prevents undesirable detachment of the fastener from the upright post 26. Thus in order to intentionally detach the fastener from post 26 it will have to be lifted up against gravity force (arrow 76) thereby detaching from flap 70. This alludes to the fact that gravity is harnessed in this connection to the stabilization of the structure of the connection once established. At this point the fact that the entire discussion of the procedure to achieve the connection of the fastener with the upright post has been conducted in the singular, the actual performance in accordance with the present invention, dictates two connections being executed at once with the two chiral perforations 32 and 34 made simultaneously, thereby providing extra strength to the connection yet allowing for thin profile walls. of both vertical and width forming frame parts to be thinned (typically by the process of rolling). Moreover according to a preferred embodiment of the invention two doublets of fasteners are employed at once, with each such connection (see FIG. 3D and FIGS. 7A-C), thereby providing additional stability parameters to the connection. Another structural feature of the fastener is explained with reference to FIGS. 5A-C. Fastener 52 is shown as it confronts the gamma perforation with which it is engageable explicitly demonstrating the role of leg 86, the front face 88 of which is shown hatched, recess 90 in leg 86 is optional.

Figure 5A:
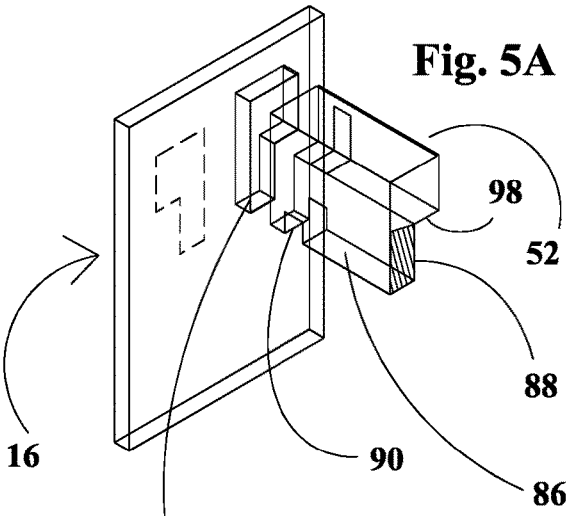
FIG. 5A is a schematic isometric views of the fastener and perforation engaging mechanism in accordance with the present invention.
Figure 5B:
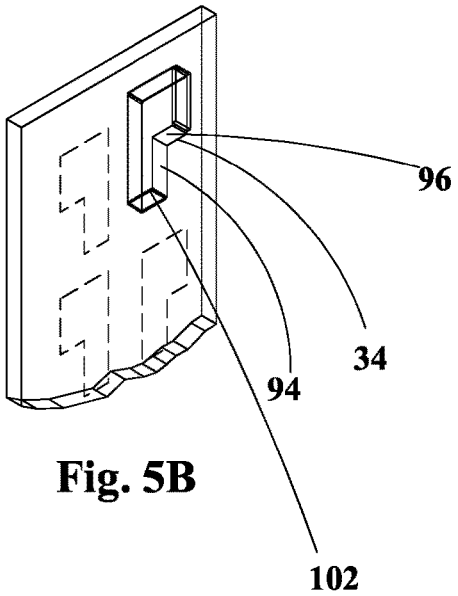
FIG. 5B is a schematic isometric view of the fastener and perforation engaging mechanism in accordance with the present invention.
Figure 5C:
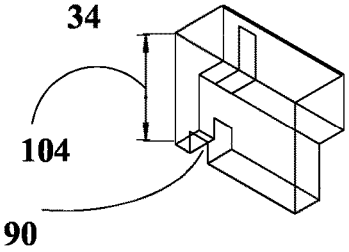
FIG. 5C illustrates the vertical length of a fastener.

The depth of the recess 90 up the leg 86 can limit the extent to which the fastener 52 can be pushed downwards when inserted inside perforation 34. As can be seen in FIG. 5B walls 94 of perforation 34 constrain the swivelling of fastener 52 and can guard against undesirable collapse of the entire structure of an erected rack in a direction parallel to post 26. In addition, inner face 96 of perforation 34 also constrains a potential swiveling of fastener 52 by abutting face 98 of fastener 52. As regards the length of leg 86, or in other words the length vertical length 104 (in FIG. 5C) or the reach of fastener 52 downwards inside perforation 34, there are several options, in some embodiments, leg 86 does not reach horizontal lowermost surface 102 of the perforation, in which case there is no reason for forming recess 90 at all in which case the fastener 52 would look as described in FIG. 4A. In other embodiments the fastener may just reach the bottom of the perforation when it is pressed downwards, and in yet other embodiments as can be seen in FIG. 5C it is longer and may reach beyond the bottom of the perforation while it is pressed downwards, if recess 90 exists and in such a case recess 90 is functional.

The Profiles of the Posts and Beams

Figure 6:
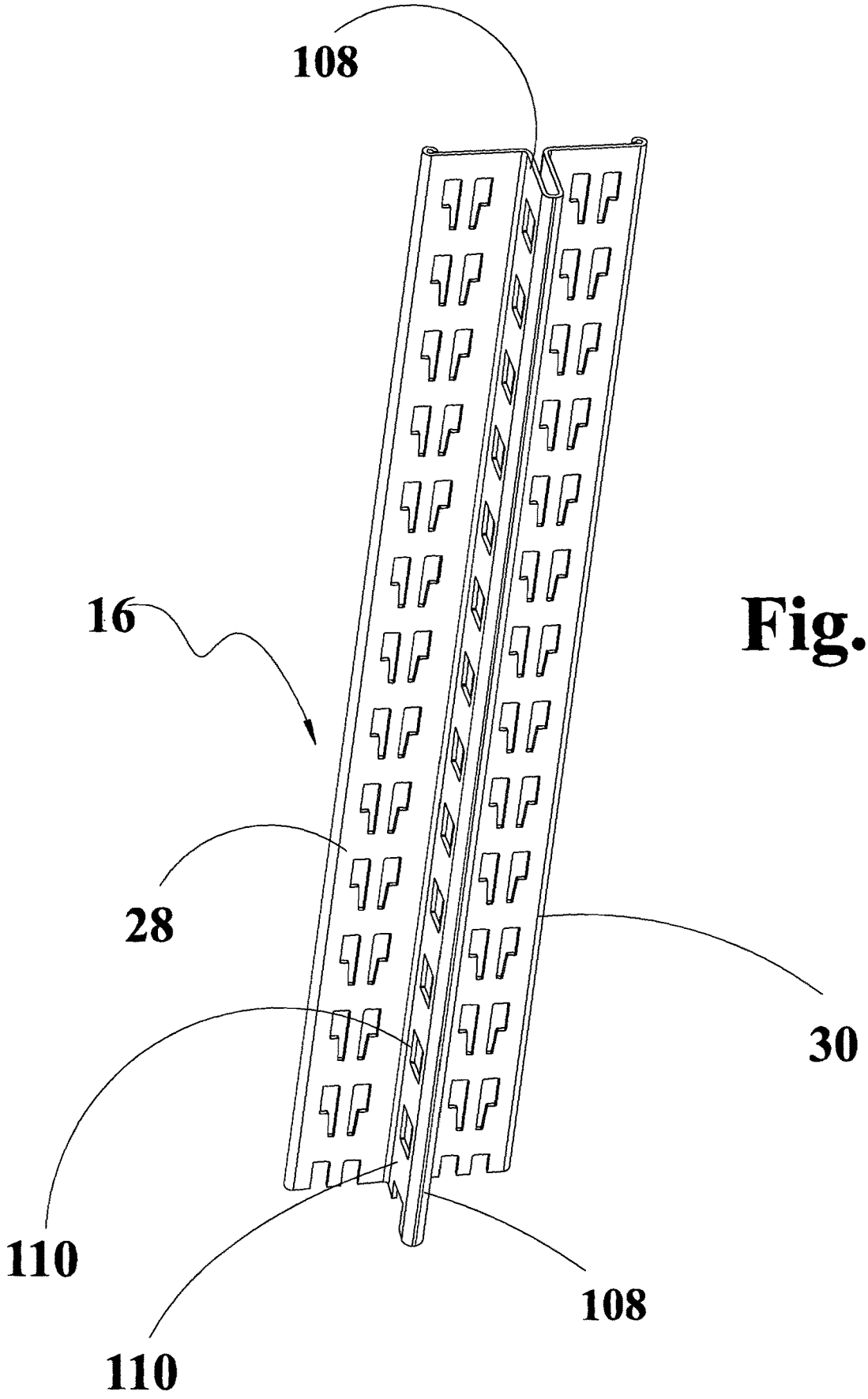
FIG. 6 illustrates an upright non voluminous post in accordance with the present invention having two types of perforations.

In an aspect of the invention, in order to save on weight while maximizing the stability and strength of the connection, the voluminous profiles of the horizontal width forming beams are made with thin walls. Typically, the upright posts are not voluminous, and are referred to hereinafter as NV posts. As can be seen in FIG. 6 NV post 26 features two flanks, 28 and 30, respectively, rib 108, perpendicular to the plain formed by flanks 28 and 30, features a columnar string of of perforations 110, these perforations on rib 108 are rectangular or even square cutouts in the rib. Thus making the rib engageable with width forming beams. These perforations serve to receive the matching fastener in the extremity of depth forming beams 20 (see FIG. 1, not shown in FIG. 6).

Figure 7A:
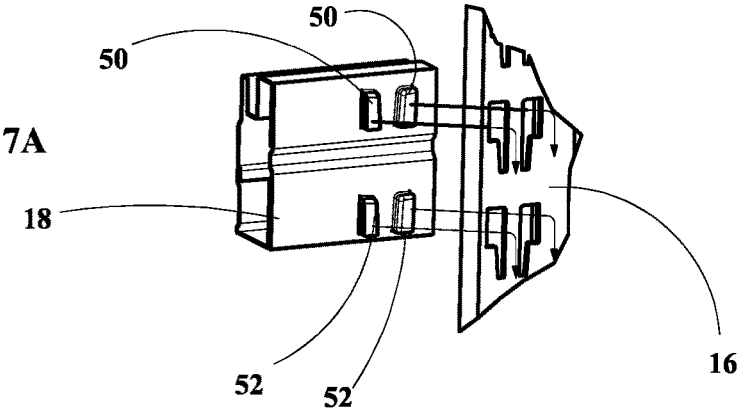
FIG. 7A depicts, pictorially, fasteners and matching perforations.
Figure 7C:
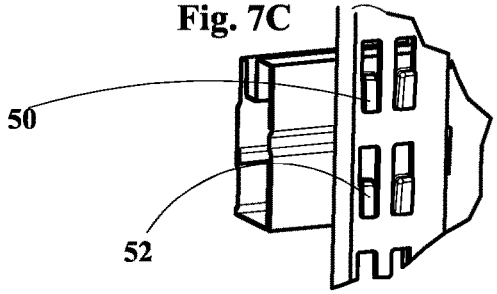
FIG. 7C depicts, pictorially, resting fasteners in matching perforations.
Figure 7B:
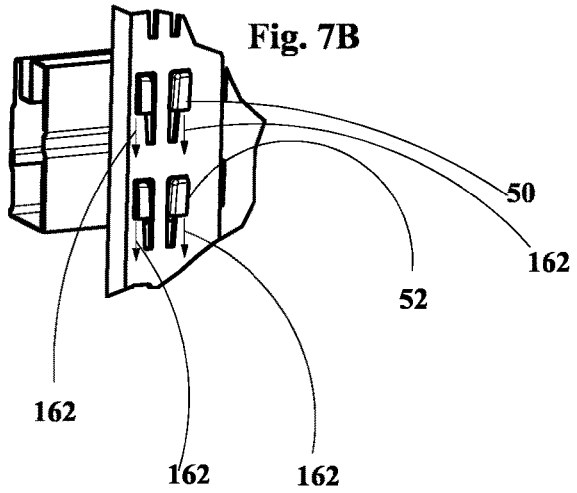
FIG. 7B depicts, pictorially, poking fasteners into matching perforations.
Figure 8A:
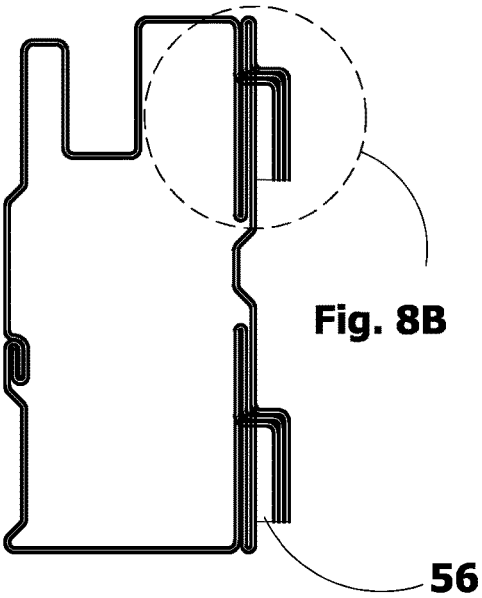
FIG. 8A is view of a recess and cover of a fastener.
Figure 8B:
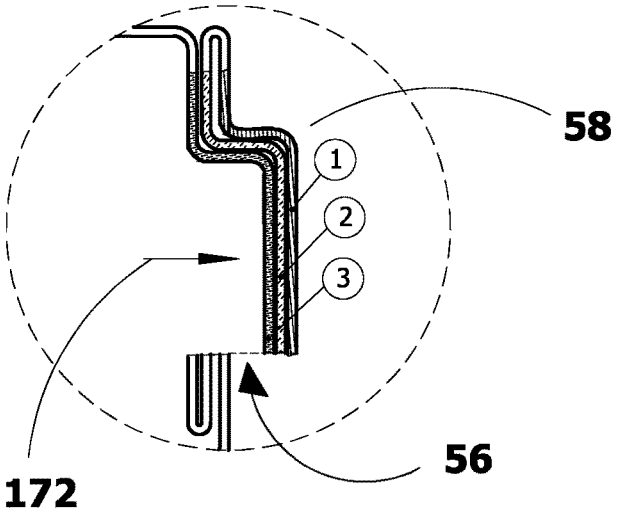
FIG. 8B is an enlarged view of a recess and cover of a fastener.

Pictorial Demonstration of the Width Forming Beams with the Upright Posts and Matching Perforations In FIGS. 7A-C the insertion of the fasteners is shown in the order of steps executed. Thus, in FIG. 7A horizontal beam 18 bears two fasteners 50 (on the upper side and two fasteners 52 on the lower side. To make the connection, all the fasteners are poked at once inside the selected perforations in the upright beam 16, as seen in FIG. 7B. Then the horizontal beam 18 is pushed downwards in the direction of arrows 162. In FIG. 7C the fasteners upper and lower are seen in their respective perforations resting at the bottom most position within the respective perforations.

The invention claimed is:

1. A rack for shelving consisting of upright posts and horizontal beams, comprising:

a column of through perforation doublets on a flank of a post of said upright posts; each through doublet of said column of through doublets including a pair of axisymetrically chirally opposed perforations;

at least one beam of said horizontal beams having a plurality of walls surrounding a hollow; a portion of one of said plurality of walls having a thickness greater than at least one of the other walls;

two rows of fasteners bent out from said portion of said one wall on each of two extremity sections of said at least one beam, each of said two rows including a fastener fitting each perforation of a perforation doublet of said column of perforation doublets so that at least four individual fasteners in said two rows of said fasteners attach simultaneously to at least four perforations of two rows of said column of said perforation doublets.

2. A rack for shelving as in claim 1, wherein at least one of the upright post includes two flanks each of which demonstrating at least one said column of said through perforation doublets.

3. The rack of claim 1, wherein said two sections are on a single wall of said at least one beam.

4. The rack of claim 1, wherein each said perforation has a gamma shape.

5. The rack of claim 1, wherein each said perforation has a broad side and a narrow side and wherein each said fastener has a leg fitting said narrow side of said perforation.

6. The rack of claim 1, wherein said portion is formed by folding said one wall over.

7. The rack of claim 6, wherein a thickness of said portion is three times the thickness of said at least one of the other walls.

8. The rack of claim 1, wherein said hollow is continuous for an entire length of said at least one beam.

9. The rack of claim 1, wherein a cross section of said at least one beam is continuous over an entire length of the at least one beam.

10. A horizontal beam for a storage rack comprising:

a plurality of walls surrounding a hollow a portion of a first wall of said plurality of walls on a first side of said hollow that is thicker than at least one of the other walls;

two rows of fasteners protruding from said portion of said first wall on each of two sections on opposite extremities of the beam, wherein each fastener of said two rows of fasteners includes a cross recess, a frontal cover protruding from said portion of said first wall of said beam and an open side wherein said frontal cover is thicker than said at least one of the other walls.

11. The beam of claim 10, wherein said frontal cover includes multiple layers of metal.

12. The beam of claim 10, wherein said portion of said first wall is made up of multiple layers of metal.

13. The beam of claim 12, wherein said metal is folded over to form said multiple layers.

14. The rack of claim 13, wherein said multiple layers include at least three layers.

15. The beam of claim 10, wherein said frontal cover of each fastener of said two rows of fasteners is an extension of said portion of said first wall bent to protrude outward.

16. The beam of claim 10, wherein said plurality of walls includes a broad wall and a narrow wall and wherein said first wall of the beam is said broad wall.

17. The beam of claim 10, wherein said hollow is continuous for an entire length of the beam.

18. The rack of claim 10, wherein a cross section of the beam is continuous over an entire length of the beam.

* * * * *